US008708752B2

(12) United States Patent
Wu

(10) Patent No.: US 8,708,752 B2
(45) Date of Patent: Apr. 29, 2014

(54) CABLE ASSEMBLY WITH LOWER PROFILE INTERFACE

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 270 days.

(21) Appl. No.: 13/231,987

(22) Filed: Sep. 14, 2011

(65) Prior Publication Data

US 2012/0064779 A1 Mar. 15, 2012

(30) Foreign Application Priority Data

Sep. 15, 2010 (CN) ..... 2010 2 0529969

(51) Int. Cl.
*H01R 9/00* (2006.01)

(52) U.S. Cl.
USPC ..... 439/660; 439/76.1

(58) Field of Classification Search
CPC ..... H01R 12/53; H01R 9/09
USPC ..... 439/660, 76.1, 687, 696, 731, 634, 686, 439/695, 701, 712, 724
See application file for complete search history.

(56) References Cited

U.S. PATENT DOCUMENTS

| | | | | |
|---|---|---|---|---|
| 6,663,415 | B1 | 12/2003 | Wu | |
| 7,261,602 | B2 * | 8/2007 | Lloyd | 439/701 |
| 7,281,937 | B2 | 10/2007 | Reed et al. | |
| 7,618,293 | B2 * | 11/2009 | Wu | 439/660 |
| 7,651,379 | B1 * | 1/2010 | Wu | 439/660 |
| 7,654,831 | B1 * | 2/2010 | Wu | 439/76.1 |
| 7,670,172 | B2 * | 3/2010 | Zhang et al. | 439/540.1 |
| 7,938,669 | B2 * | 5/2011 | Li et al. | 439/352 |

* cited by examiner

*Primary Examiner* — Felix O Figueroa
(74) *Attorney, Agent, or Firm* — Wei Te Chung; Ming Chieh Chang

(57) ABSTRACT

A cable assembly (100), includes: a case (2) having a receiving room (25); two paralleled printed circuit boards (3) received into the receiving room; a terminal module 4 disposed in the receiving room and electrically connected with two front portions of two printed circuit boards and a clip (1) assembled to the terminal module. The terminal module has an upper terminal unit (41) and a lower terminal unit (42) assembled with each other in a back-to back manner and clamped with each other by the clip.

17 Claims, 13 Drawing Sheets

CABLE ASSEMBLY WITH LOWER PROFILE INTERFACE

FIELD OF THE INVENTION

The present invention relates to a cable assembly, and more particularly to a high speed cable assembly with a new interface for mating with a complementary connector.

DESCRIPTION OF PRIOR ART

PCI (Peripheral Component Interconnect) Express Association has released an External Cabling Specification Revision 1.0 in January, 2007. The above said Specification discloses a high speed cable assembly which is marked as X16 cable assembly. The cable assembly comprises a metallic housing, a pair of PCBs (Printed Circuit Boards) disposed in the housing and a cable electrically connected with the pair of PCBs, the pair of PCBs are arranged paralleled with each other in a vertical direction. The cable assembly further has a latching member and a pulling member assembled on a top surface of the metallic housing, the latching member is connected with the pulling member and actuated by the pulling member.

However, the height of an interface of the cable assembly will be increased due to the setting of the pair of PCBs. Thus, the interface of the cable assembly can not meet the developing trend of low profile. On another aspect, the signal transmitting speed of the cable assembly is required more and more quickly, thus, the conductive pads of the printed circuit board will also be increased. However, when the width of the PCB is determined, the more conductive pads should be formed on the PCB, so the layout of the printed circuit board will be more difficulty.

As discussed above, an improved cable assembly overcoming the shortages of existing technology is needed.

SUMMARY OF THE INVENTION

Accordingly, an object of the present invention is to provide a cable assembly with a new mating face.

In order to achieve the above-mentioned objects, a cable assembly, comprises: a case having a receiving room; two paralleled printed circuit boards received into the receiving room; a terminal module disposed in the receiving room and electrically connected with two front portions of the two printed circuit boards, the terminal module having an upper terminal unit and a lower terminal unit engaged with each other in a back-to back manner; and a clip assembled to the terminal module to clamp the upper terminal unit and the lower terminal unit.

Other objects, features and advantages of the invention will be apparent from the following detailed description taken in connection with the accompanying drawings.

DETAILED DESCRIPTION OF PREFERRED EMBODIMENTS

Figure 1:
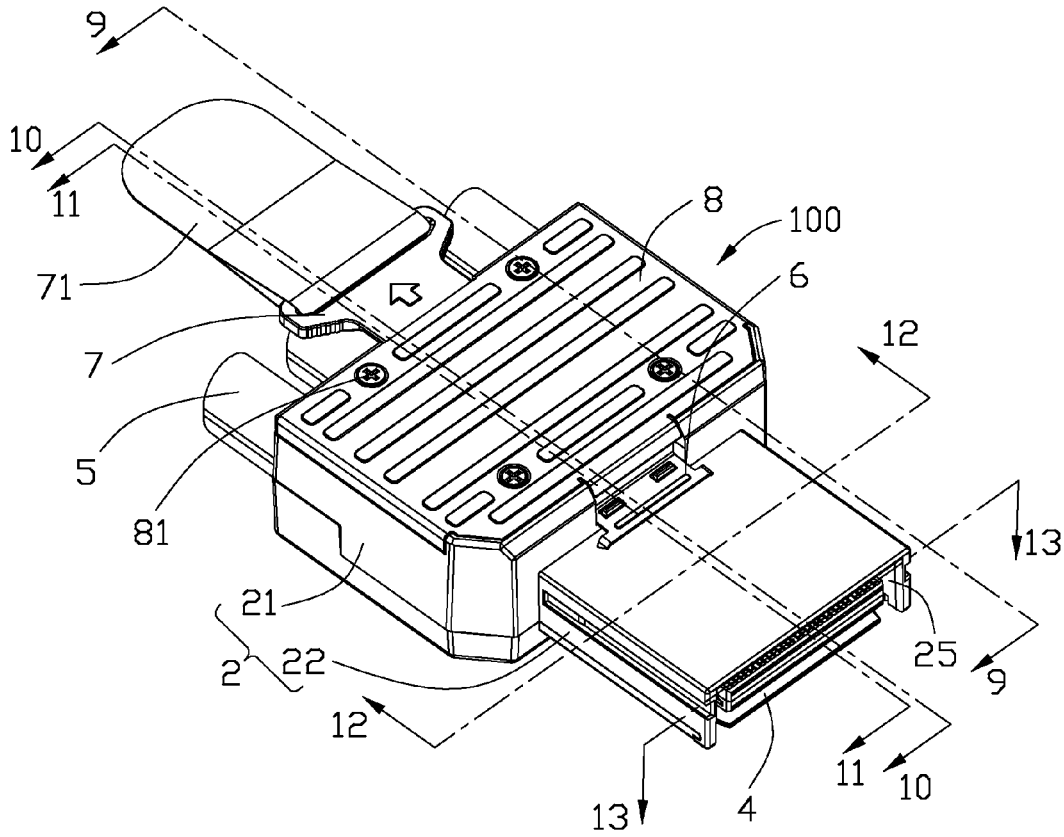
FIG. 1 is a perspective view of a cable assembly in accordance with the present invention.
Figure 2:
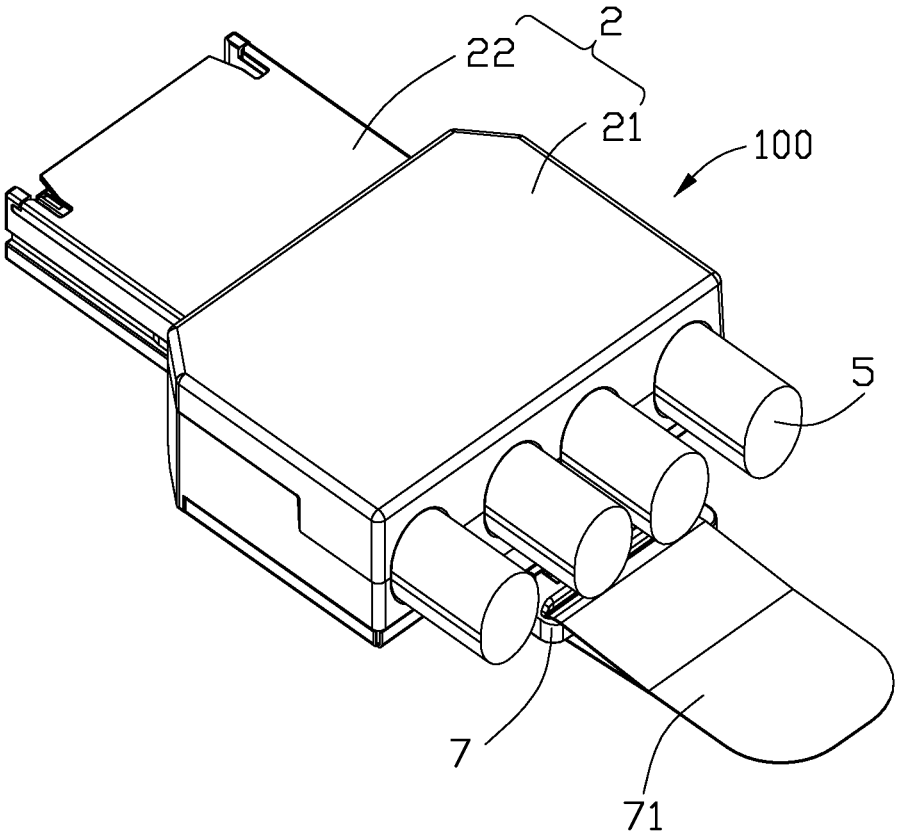
FIG. 2 is another perspective view of the cable assembly of FIG. 1.

Reference will now be made to the drawing figures to describe the present invention in detail.

Please refer to FIGS. 1 to 6, a cable assembly 100 made in accordance with the present invention mates with a complementary connector (not shown). The cable assembly 100 comprises a case 2, a pair of printed circuit boards 3 received into the case 2, an insulative spacer 9 disposed between the two printed circuit boards 3, a terminal module 4 electrically connected with two front ends of the two printed circuit boards 3, a plurality of cables 5 extended into the case 2 and electrically connected with two rear ends of the two printed circuit boards 3. The cable assembly 100 further comprises a latching member 6 and a pulling member 7 assembled to a top surface of the case 2, and a shielding member 8 assembled to the top surface of case 2 and shielding a part of the latching member 6 and the pulling member 7.

Figure 9:
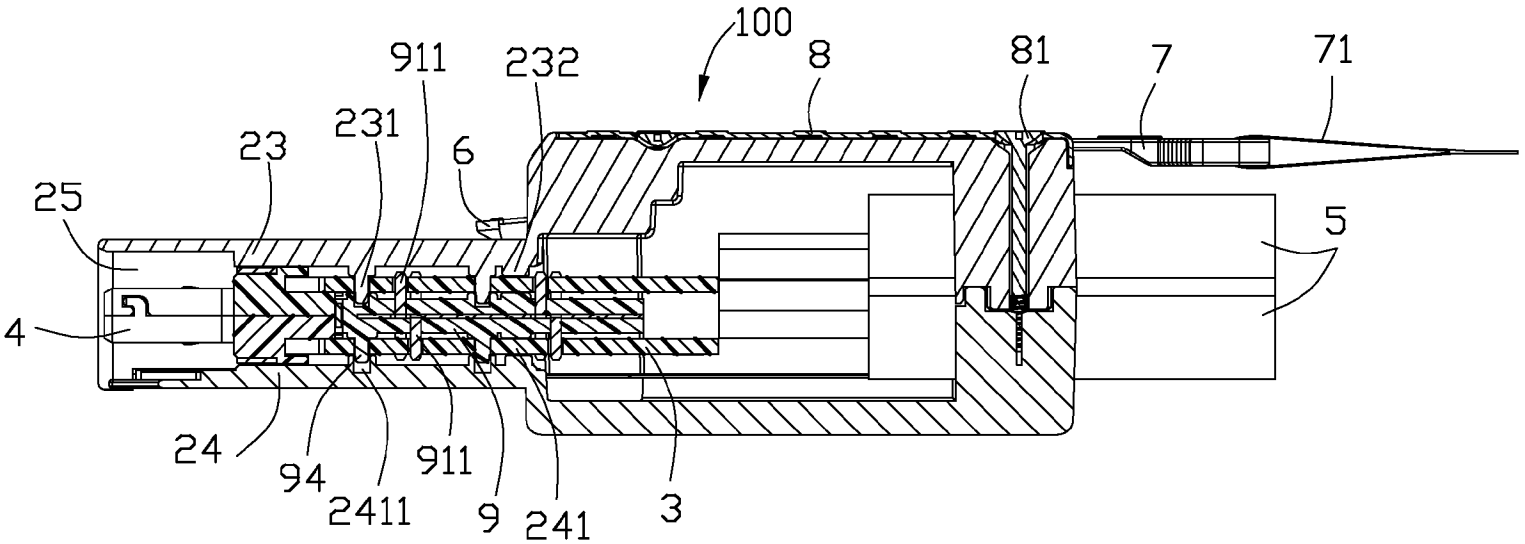
FIG. 9 is a cross section view of the cable assembly of FIG. 1 taken along line 9-9.

Referring to FIGS. 3 to 6 and in conjunction with FIG. 9, the case 2 is made of metallic material and comprises a base portion 21 and a mating portion 22 extending forward from the base portion 21. The cross-section size of the mating portion 22 is smaller than that of the base portion 21. The case 2 defines a receiving room 25 extending from a front surface (not figured) to the rear surface (not figured) thereof. The receiving room 25 is used for receiving the two printed circuit boards 3 and the terminal module 4. The case 2 includes an upper cover 23 and a lower cover 24 engaged with each other. The receiving room 25 is formed by the upper cover 23 and the lower cover 24. The lower cover 24 defines a plurality of supporting posts 241 formed on a top surface (not figured) of a front section of the lower cover 24 for supporting a printed circuit board 3. The supporting posts 241 are divided into two rows respectively located at two sides of the top surface (not figured) of the front section of the lower cover 24. At least one supporting post 241 defines a receiving hole 2411. The upper cover 23 defines a plurality of positioning posts 231 and supporting posts 232 formed on bottom surface of a front section thereof. The positioning posts 231 and supporting posts 232 are used for positioning and supporting another printed circuit board 3.

Referring to FIGS. 3 to 6, each of the printed circuit board 3 has a mating portion 31 formed at a front section thereof, a terminating portion 33 formed at a rear section thereof and a connecting portion 32 connected with the mating portion 31 and the terminating portion 33. The mating portion 31 defines a plurality of conductive pads formed on two opposite top and bottom surfaces thereof. The plurality of conductive pads includes a plurality of first and second conductive pads 311, 312. The first conductive pads 311 are disposed in the front of the second conductive pads 312. And the number of the first conductive pads 311 is smaller than that of the second conductive pads 312. Each second conductive pad 312 is in alignment with a first conductive pad 311 along a front to rear direction. The connecting portion 32 defines a plurality of through holes 321 formed at two lateral sides thereof. The terminating portion 33 defines a plurality of third conductive pads 331 formed on two opposite top and bottom surfaces thereof.

Referring to FIGS. 3 to 6 and in conjunction with FIG. 9, the spacer 9 is made of insulative material and has a metallic grounding piece 91 integrative formed therein. The grounding piece 91 defines a plurality of vertical sticks 911 formed at two sides thereof and respectively extending out of the top and bottom surfaces of the spacer 9. The plurality of vertical sticks 911 of the grounding piece 9 are inserted into the through holes 321 of the two printed circuit boards 3 when the two print circuit boards are disposed at two sides of the spacer 9. Thus, the grounding piece 9 is electrically connected to the two printed circuit boards 3. The spacer 9 defines a plurality of cylindrical projections 92 formed on a top surface thereof. At least one cylindrical projection 92 defines a receiving hole 921 corresponding to a through hole 321 along a vertical direction. Each of positioning post 231 of the upper cover 23 is passed through the through hole 321 and received into the receiving hole 921 of the cylindrical projection 92. The spacer 9 defines a plurality of projections 93 and positioning posts 94 formed on a bottom surface thereof. Each of the positioning post 94 is passed through the through hole 321 and received into the receiving hole 2411.

Referring to FIGS. 3 to 6, the terminal module 4 includes an upper terminal unit 41 and a lower terminal unit 42 assembled with each other in back-to-back manner. The upper terminal unit 41 has a same structure with the lower terminal unit 42. The upper terminal unit 41 defines an top surface 411 and a bottom surface 412 opposite to the top surface 411. The lower terminal unit 42 also defines a top surface 421 and a bottom surface 422 opposite to the top surface 421. The upper terminal unit 41 defines a first barb 413 and a first recess 414 respectively formed on a bottom surface 412 thereof. The first barb 413 and the first recess 414 are respectively located at two sides of the bottom surface 412. The lower terminal unit 42 defines a second barb 423 and a second recess 424 formed on a bottom surface 422 thereof. And, the second barb 423 and the second recess 424 are located at two sides of the bottom surface 422 thereof. When upper terminal unit 41 is assembled to the second terminal unit 42 in a back-to-back manner, the bottom surface 412 of the upper terminal unit 41 is attached to the bottom surface 422 of the lower terminal unit 42. As a result, the first barb 413 of the upper terminal unit 41 is cooperated with the second recess 424 of the lower terminal unit 42. The second barb 423 of the lower terminal unit 42 is cooperated with the first recess 414 of the upper terminal unit 41. Thus, upper terminal unit 41 and lower terminal unit 42 are preliminary engaged with each other by the structures respectively formed thereon. At this time, the top surface 411 of the upper terminal unit 41 is defined as a top mating surface of the terminal module 4. The top surface 421 of the second terminal unit 42 is defined as a bottom mating surface of the terminal module 4.

Referring to FIGS. 3 to 8, the upper terminal unit 21 and the lower terminal unit 22 are not firmly interconnected with each other only by the first and second barbs 413, 423 cooperated with the first and second recesses 414, 424. So, the cable assembly 100 further defines a metallic clip 1 binding the upper and lower terminal units 21, 22 together to achieve a firm engagement therebetween. The clip 1 defines a main portion 11 surrounding the upper and lower terminal units 21, 22 and a pair of latching portions 12 latching to a rear end of the terminal module 2.

Referring to FIGS. 3 to 11, the upper terminal unit 41 defines a set of first terminals 43 and a set of second terminals 44 formed therein and respectively arranged along a transversal direction. Each of the first terminal 43 has a front mating section 431 formed on a top surface of the terminal module 4. Each of the second terminal 44 has a front mating section 441 formed on a top surface of the terminal module 4. And, the front mating sections 431 of first terminals 43 are located in front of the front mating sections 441 of the second terminals 44 along a front-to-rear direction. The lower terminal unit 42 also defines a set of first terminals 43 and a set of second terminals 44 formed therein and respectively arranged along a transversal direction. Each of the first terminal 43 has a front mating section 431 formed on a bottom surface of the terminal module 4. Each of the second terminal 44 has a front mating section 441 formed on a bottom surface of the terminal module 4. And, the front mating sections 431 of first terminals 43 are also located in front of the front mating sections 441 of the second terminals 44 along a front-to-rear direction. Two sets of first terminals 43 of the terminal module 4 defines two sets of rear terminating sections 432 extending rearwardly for a distance from a rear surface of the terminal module 4. Two sets of second terminals 44 of the terminal module 4 defines two sets of rear terminating sections 442 extending rearwardly for a distance from a rear surface of the terminal module 4.

Referring to FIGS. 3 to 11, the upper and lower terminal unit 41, 42 respectively includes a first terminal unit 45 and a second terminal unit 46 assembled to a rear end of the first terminal unit 45. Two sets of first terminals 43 are respectively formed in two first terminal units 45 of the upper and lower terminal units 41, 42. And two sets of second terminals 44 are respectively formed in two second terminal units 46 of the upper and lower terminal units 41, 42. The first and second terminal units 45, 46 are both formed in a way of insert molding. Each set of first terminals 43 comprises a plurality of first signal terminals 47 and a plurality of grounding terminals 48 spaced with each other. The plurality of second terminals 44 are defined as second signal terminals. And, the mating sections 431 of the first signal terminals 47 are respectively in alignment with the mating sections 441 of the second signal terminals 44 along a front-to-rear direction. A pair of differential signal terminals are formed by a first signal terminal 47 and a second signal terminal 44.

Figure 3:
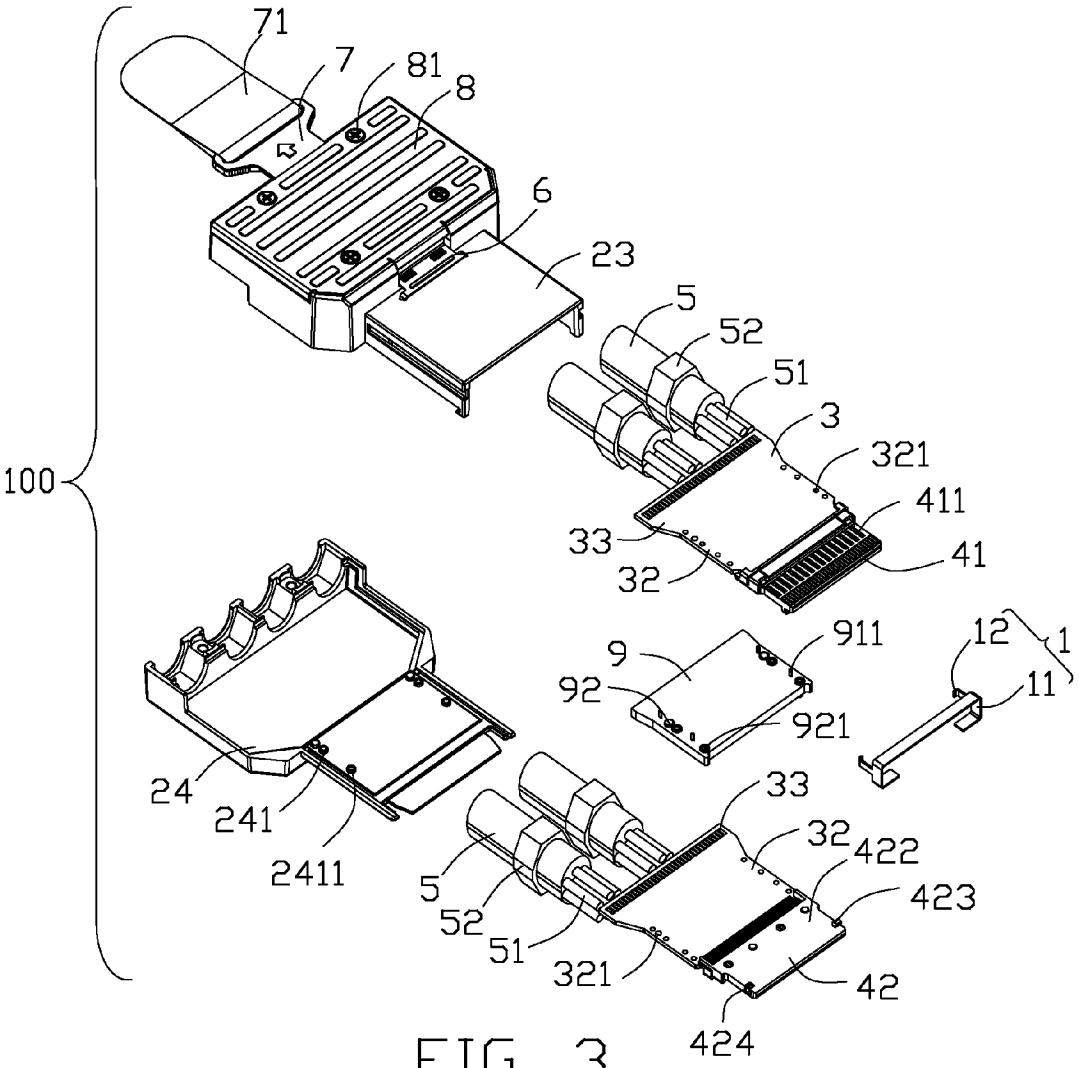
FIG. 3 is a partial assembled view of the cable assembly of FIG. 1.
Figure 4:
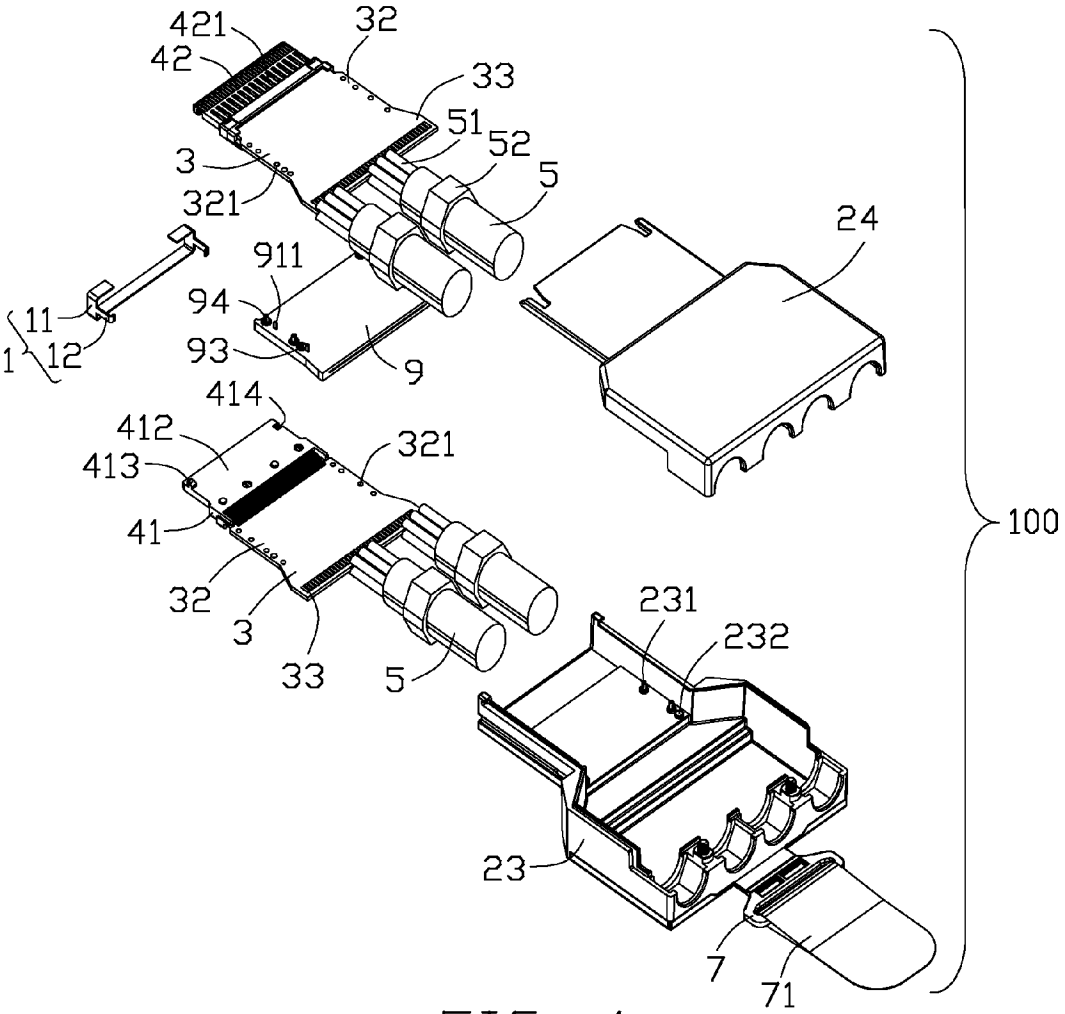
FIG. 4 is similar to FIG. 3, but viewed from another aspect.
Figure 5:
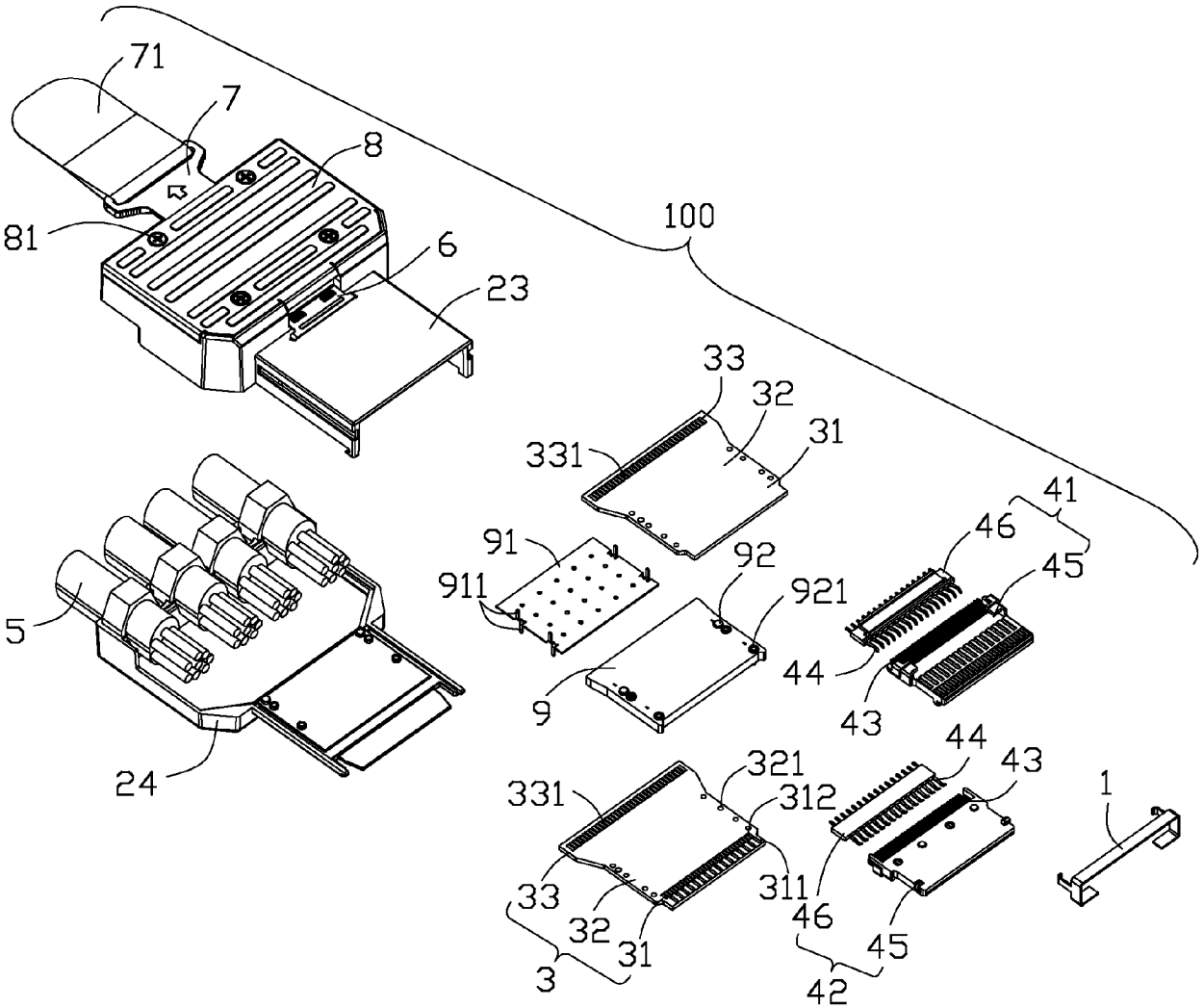
FIG. 5 is another partial assembled view of the cable assembly of FIG. 1.
Figure 6:
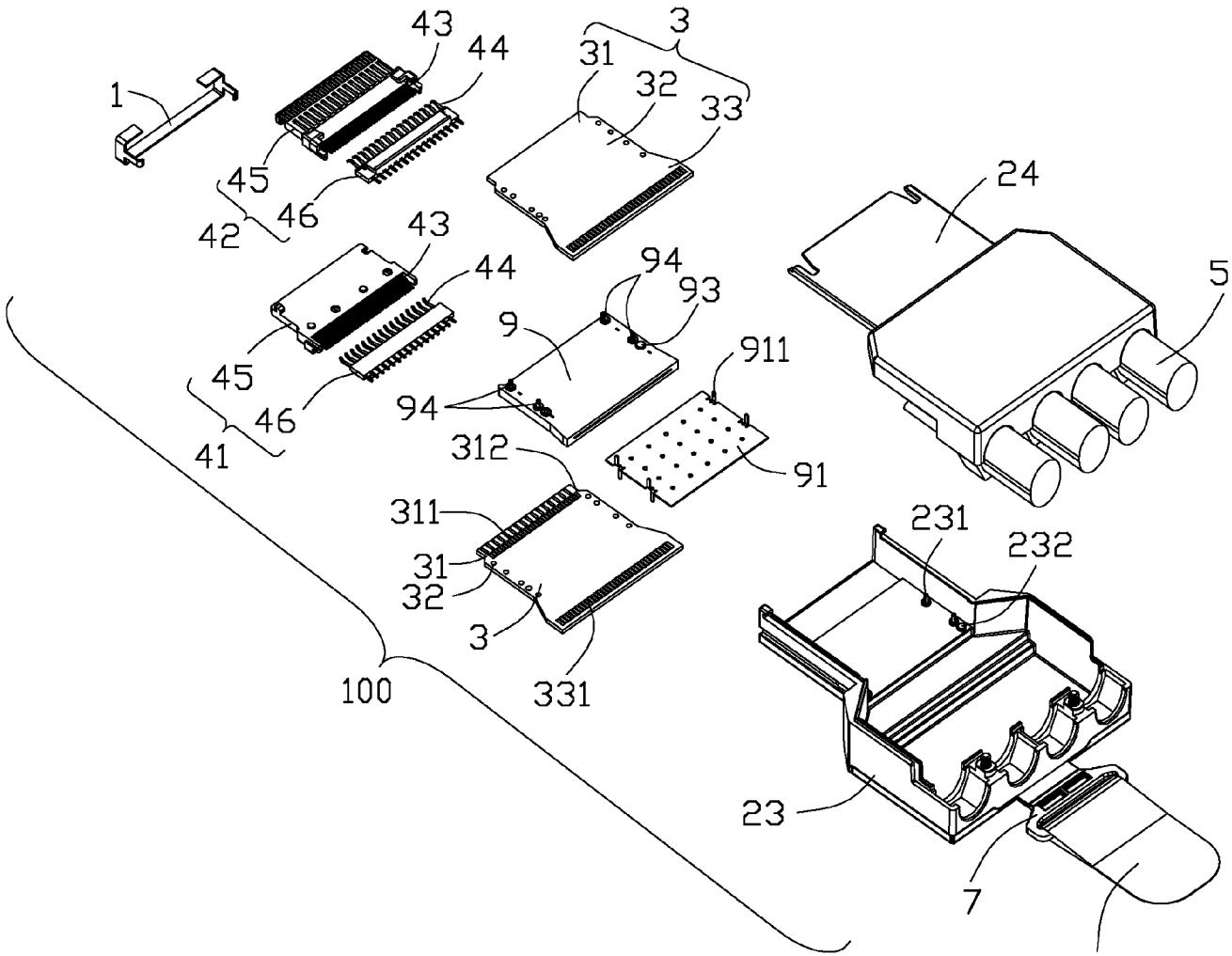
FIG. 6 is similar to FIG. 5, but viewed from another aspect.
Figure 7:
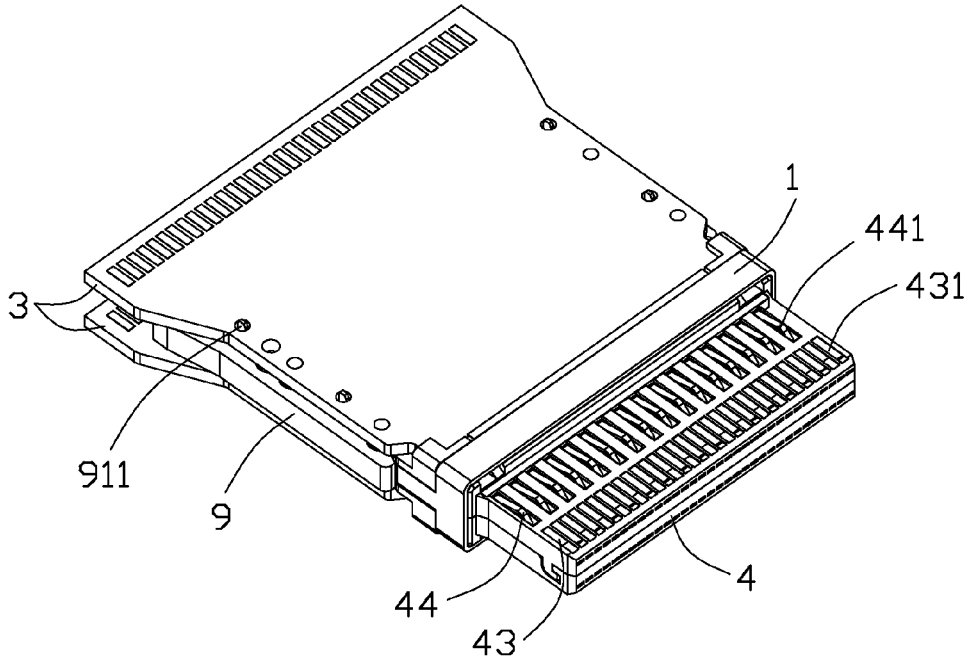
FIG. 7 is an enlarged perspective view of a terminal module and two printed circuit boards assembled with each other shown in FIG. 3.
Figure 8:
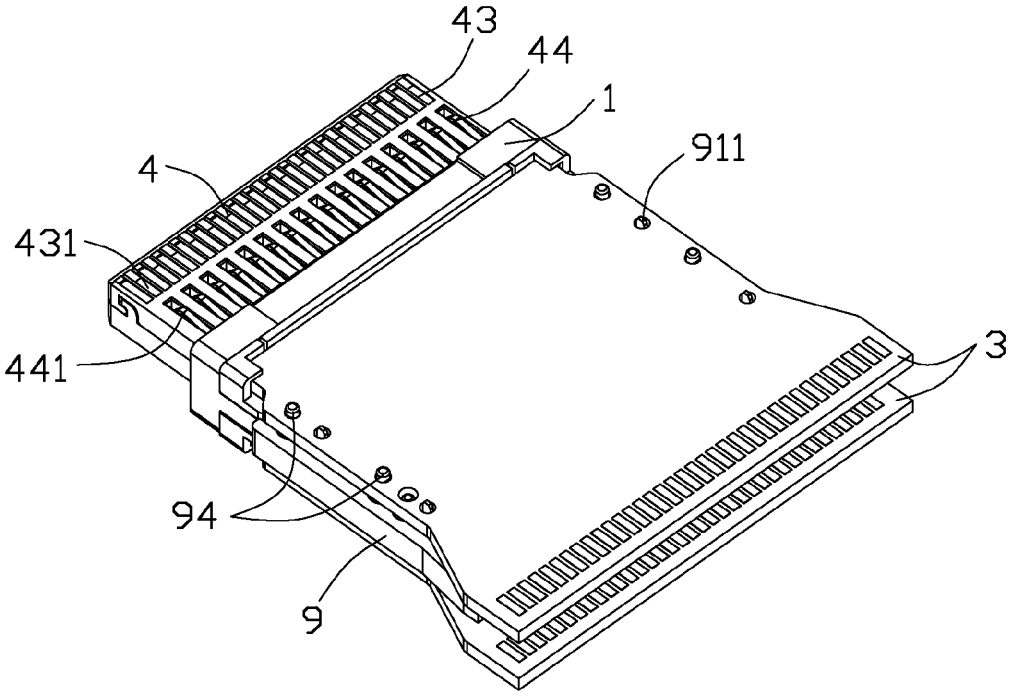
FIG. 8 is similar to FIG. 7, but viewed from another aspect.

Referring to FIGS. 3 to 4, a plurality of cables 5 are electrically connected with two printed circuit boards 3. Each of the cable 5 defines a plurality of conductive wires 51 and a ring 52 surrounding the cable 5.

Figure 10:
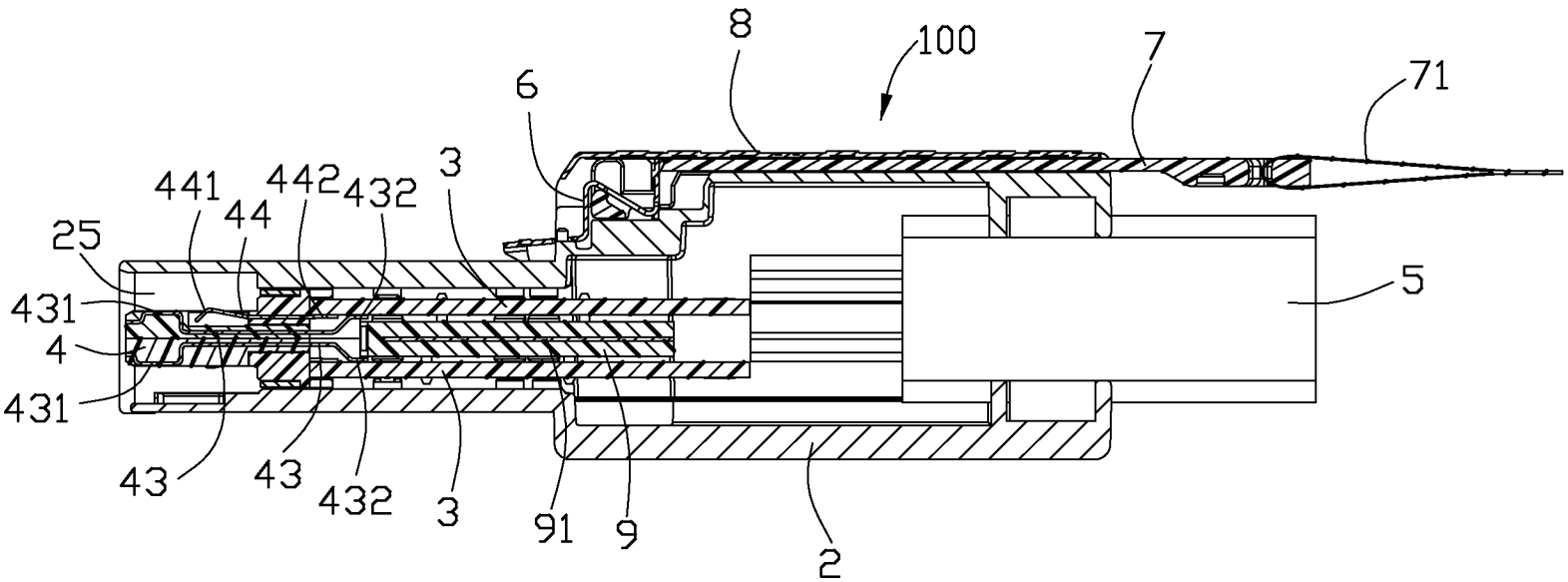
FIG. 10 is a cross section view of the cable assembly of FIG. 1 taken along line 10-10.
Figure 11:
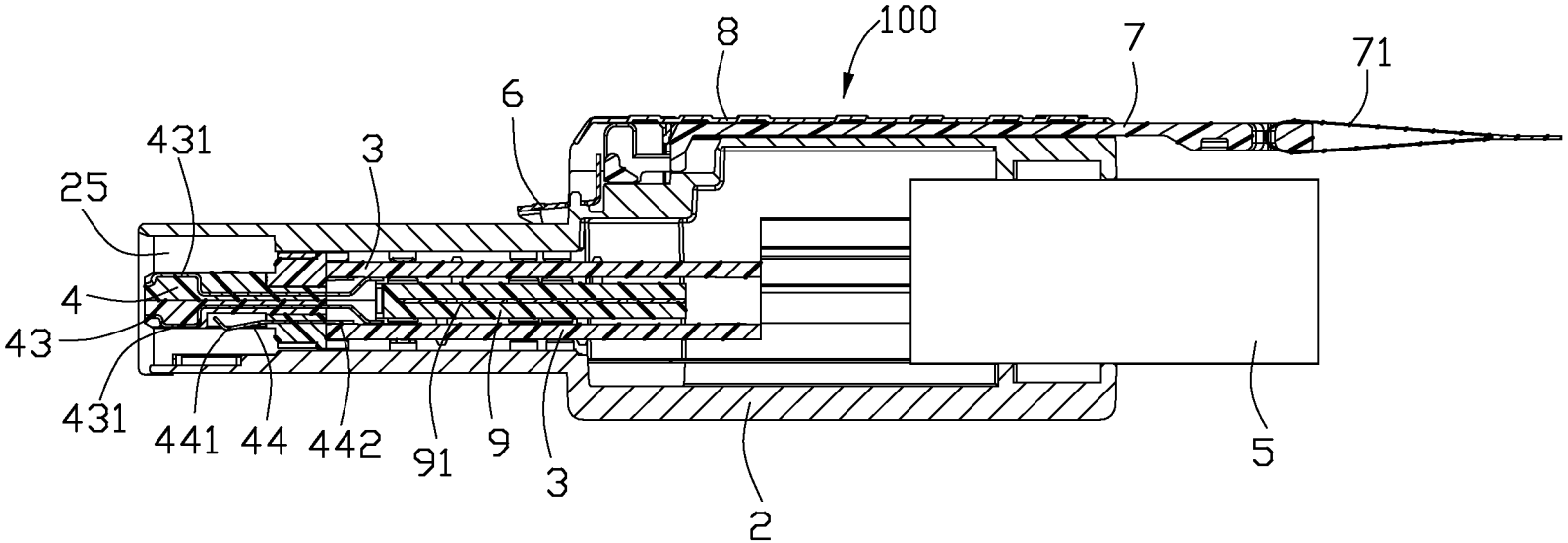
FIG. 11 is a cross section view of the cable assembly of FIG. 1 taken along line 11-11.
Figure 12:
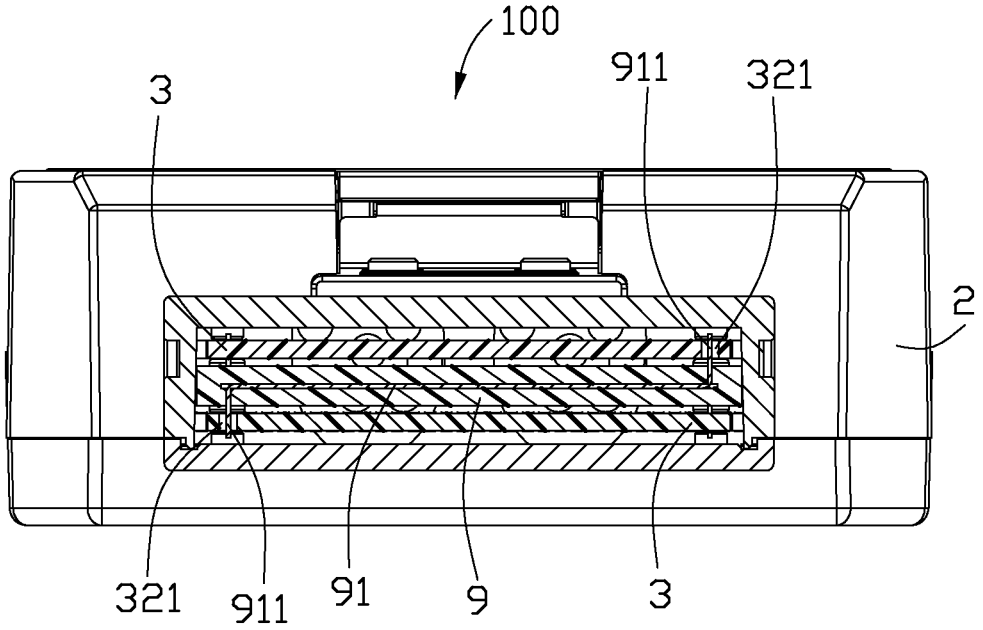
FIG. 12 is a cross section view of the cable assembly of FIG. 1 taken along line 12-12.
Figure 13:
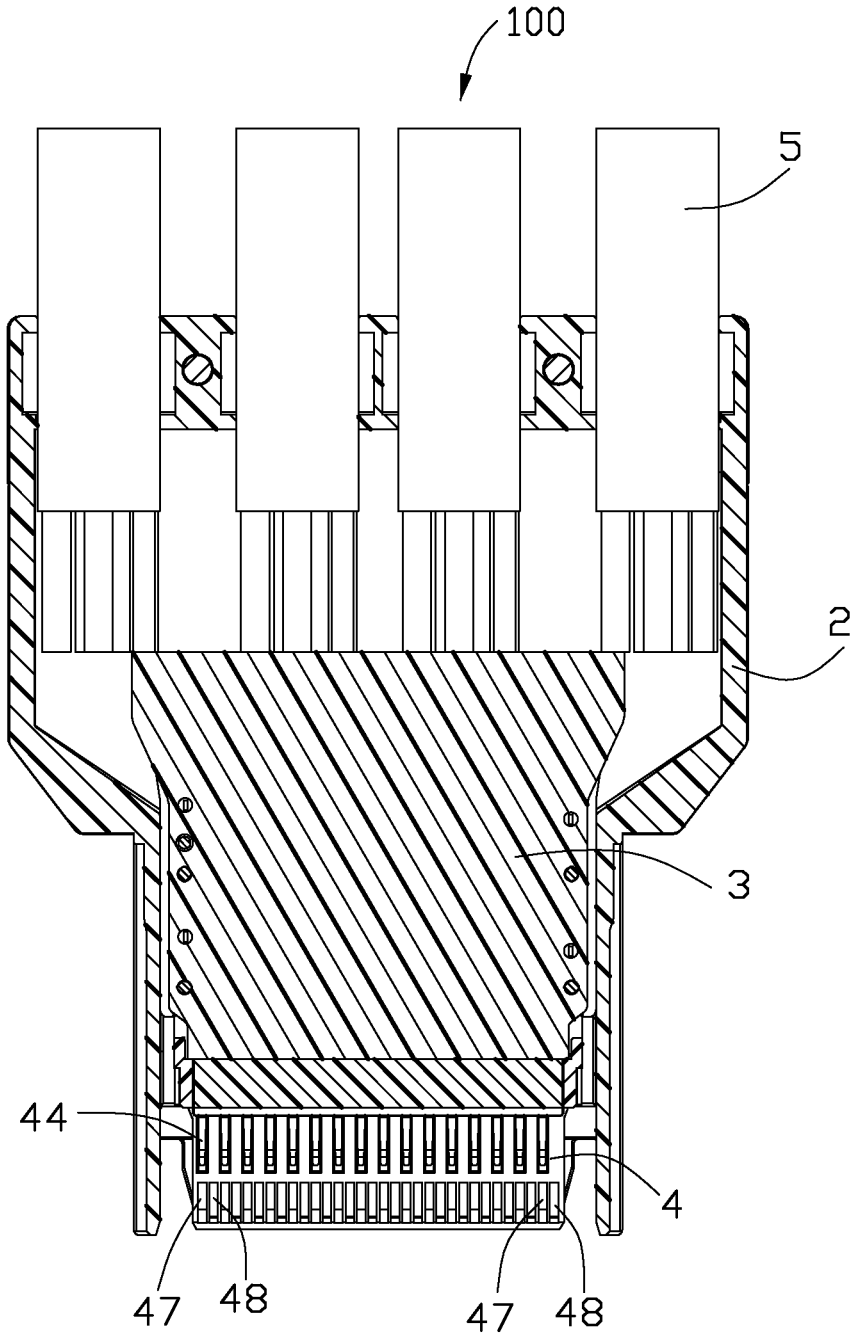
FIG. 13 is a cross section view of the cable assembly of FIG. 1 taken along line 13-13.

Referring to FIG. 1 and in conjunction with FIG. 10, the latching member 6 is assembled to a top surface of the base portion 21 of the metallic case 2. A rear end of the latching member 6 is fixed on the metallic case 2, a front end of the latching member 6 is cantilevered to the rear end of the latching member 6. The pulling member 7 has a front end (not figured) connected with a portion (not figured) of the latching member 6. A tape 71 is attached to a rear end of the pulling member 7. When a rearward pulling force exerts on the pulling member 7 or the tape 71, the front end of the pulling member 7 will actuate the latching member 6 and make the front end of the latching member 6 moving upwardly. When the pulling force is released, the front end of the latching member 6 will be resumed to an original state.

Referring to FIGS. 1 and 9, the shielding member 8 is made of metallic material and assembled to a top surface of the base portion 21 of the metallic case 2. Thus, a rear portion of the latching member 6 and a front portion of the pulling member 7 are shielded by the shielding member 8. The shielding member 8 is assembled to the case 2 through a plurality of engaging devices 81. Each of the engaging device 81 is a screw.

Referring to FIGS. 1 to 13, the assembling process of the cable assembly 100 made in according to the present invention starts from assembling the first terminal unit 45 to the second terminal unit 46. As a result, the upper terminal unit 41 and the lower terminal unit 42 are respectively formed by the first and second terminal units 45, 46. It should be noted that the first terminal unit 45 and the second terminal unit 46 are formed in advance.

After the upper terminal unit 41 and the lower terminal unit 42 are formed, then assembling the two printed circuit boards 3 respectively to two rear ends of the upper and lower terminal units 41, 42. The terminating sections 432 of the first terminals 43 of the upper terminal unit 41 are soldered to the second conductive pads 312 of the mating portion 31 of the printed circuit board 3. The terminating sections 442 of the second terminals 44 of the upper terminal unit 41 are soldered to the first conductive pads 311 of the mating portion 31 of the printed circuit board 3. Thus, the upper terminal unit 41 is electrically and mechanically connected to one printed circuit board 3. So, the lower terminal unit 42 is electrically and mechanically connected to another printed circuit board 3 through assembling steps between the upper terminal unit 41 and the printed circuit board 3.

Then, the upper terminal unit 41 and the lower terminal unit 42 are assembled with each other in a back-to-back manner. Thus, the terminal module 4 is formed. At the same time, the spacer 9 is sandwiched between two printed circuit boards 3. It should be noted that the vertical sticks 911 of the grounding piece 91 of the spacer 9 are inserted into the through holes 321 of the two printed circuit boards 3 to achieve an electrical connection between the grounding piece 91 and the two printed circuit boards 3.

Then, the clip 1 is assembled to the upper terminal unit 41 and the lower terminal unit 42 to clamp the upper terminal unit 41 and the lower terminal unit 42. The main portion 11 of the clip 1 is surrounded the upper and lower terminal units 41, 42. The pair of latching portions 12 are latched to a rear end of the terminal module 4. Thus, the upper terminal unit 41 and the lower terminal unit 42 are firmly engaged with each other.

Then, the third conductive pads 331 of the terminating portion 33 of each printed circuit board 3 are soldered to the conductive wires 51 of the cables 5.

After the cables 5 are assembled to the two printed circuit boards 3, then assembling the terminal module 4, the two printed circuit boards 3 and the cables 5 to the lower cover 24. The free ends of the positioning posts 94 of the upper cover 23 are passed through the corresponding through holes 321 of the printed circuit board 3 and received into the receiving holes 2411 of the supporting posts 241 of the lower cover 24.

Then, assembling the upper cover 23 with the latching member 6 and the pulling member 7 to the lower cover 24. The positioning posts 231 of the upper cover 23 are passed through the through hole 321 and received into the receiving hole 921 of the cylindrical projection 92 of the spacer 9. Thus, two printed circuit boards 3 and the spacer 9 are positioned with the upper and lower covers 12, 24.

Finally, assembling the shielding member 8 to the top surface of the base portion 21 of the metallic case 2 and assembling a plurality of screws 81 to the upper cover 23 and the lower cover 24 along an up to down direction. Thus, the upper cover 23, the shielding member 8 and the lower cover 24 are engaged with other by the screws 81.

After the above assembling steps, the entire process of assembling of the cable assembly 100 is finished. The cable assembly 100 has a new mating interface with a high speed signal transmitting. And, the new interface of the cable assembly 100 is structured in a lower profile.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly for connecting with a complementary connector, comprising:

a metallic case having a receiving room;

a terminal module disposed in the receiving room, the terminal module having an upper terminal unit and a lower terminal unit back-to-back stacked with each other;

a metallic clip clamped the upper terminal unit and the lower terminal unit along a vertical direction; and a cable extended into the receiving room and electrically connected with the terminal module, wherein the metallic clip defines a main portion surrounding the upper and lower terminal units and a pair of latching portions latching to a rear end of the terminal module.

2. The cable assembly as recited in claim 1, wherein the terminal module further defines a set of first terminals and a set of second terminals formed therein, each of first terminal and second terminal respectively has a mating section extending to a top surface of the terminal module, the mating section of each second terminal is in alignment with a mating section of a first terminal along a front to rear direction.

3. The cable assembly as recited in claim 1, wherein the upper and lower terminal unit respectively has a first terminal unit and a second terminal unit assembled with each other.

4. A cable assembly, comprising:

a case having a receiving room;

two paralleled printed circuit boards received into the receiving room;

a terminal module disposed in the receiving room and electrically connected with two front portions of the two printed circuit boards, the terminal module having an upper terminal unit and a lower terminal unit engaged with each other in a back-to back manner; and a metallic clip assembled to the terminal module to clamp the upper terminal unit and the lower terminal unit, wherein the metallic clip defines a main portion surrounding the upper and lower terminal units and a pair of latching portions latching to a rear end of the terminal module;

wherein the case defines a body portion and a mating portion extending forwardly from the body portion, the terminal module located in the mating portion.

5. The cable assembly as recited in claim 4, wherein the cable assembly further comprises a plurality of cables extending into the receiving room and electrically connected to the two printed circuit boards.

6. The cable assembly as recited in claim 4, wherein the cable assembly further comprises a spacer sandwiched by the two printed circuit boards, and the spacer defining a grounding piece having a plurality of sticks inserted into the two printed circuit boards.

7. The cable assembly as recited in claim 4, wherein the cable assembly further comprises a latching member and a pulling member engaged with each other and assembled to an exterior surface of the case.

8. The cable assembly as recited in claim 4, wherein the terminal module defines two sets of first terminals and two sets of second terminals formed therein, a set of first terminals and a set of second terminals respectively having mating sections formed on a top surface of the terminal module, a set of first terminals and a set of second terminals respectively having mating sections formed on a bottom surface of the terminal module, and the mating sections of the first terminals located in front of the mating sections of the second terminals.

9. The cable assembly as recited in claim 8, wherein each set of first terminals comprises a plurality of first signal terminals and a plurality of grounding terminals, each set of second terminals comprises a plurality of second signal terminals, the mating sections of the first signal terminals respectively in alignment with the mating sections of the second signal terminals along a front to rear direction.

10. The cable assembly as recited in claim 8, wherein the upper and lower terminal units respectively comprises a first terminal unit and a second terminal unit assembled to a rear end of the first terminal unit, each set of first terminals formed in the first terminal unit, each set of second terminals formed in the second terminal unit.

11. A cable connector assembly comprising: two identical terminal modules back to back stacked with each other via corresponding inner surfaces intimately facing to each other, each of said terminal modules including a plurality of contacts each defining a front contacting section and a rear mounting section;

further including a pair of printed circuit boards located behind the two terminal modules, respectively, and facing to each other via opposite interior surfaces with an insulative spacer therebetween in a vertical direction, wherein in each of the said two terminal modules, the front contacting sections of said contacts are exposed upon an outer surface of the terminal module and isolated from those of the other of said two terminal modules in the vertical direction while the rear mounting sections of the contacts are mounted to the interior surface of a corresponding printed circuit board;

a pair of covers commonly sandwiching the pair of printed circuit boards therebetween in the vertical direction;

wherein the two terminal modules are assembled together via a metallic clip, said metallic clip defines a main portion surrounding the two terminal modules and a pair of latching portions latched to a rear of the two terminal modules.

12. The cable connector assembly as claimed in claim 11, wherein a metallic grounding plate is embedded in the spacer to separate the pair of printed circuit boards in the vertical direction while no metallic grounding plate is located between the terminal modules in the vertical direction.

13. The cable connector assembly as claimed in claim 12, wherein the grounding plate defines a plurality of vertical sticks extending through the spacer and mechanically and electrically connected to the corresponding printed circuit board.

14. The cable connector assembly as claimed in claim 11, wherein the spacer unitarily defines a plurality of positioning posts extending vertically into the corresponding printed circuit boards, respectively.

15. The cable connector assembly as claimed in claim 11, wherein each of said covers defines a plurality of positioning posts vertically extending through the corresponding printed circuit board into the spacer.

16. The cable connector assembly as claimed in claim 11, wherein the mounting sections of the contacts of one of said two terminal modules communicatively, in the vertical direction, face toward those of the other of said two terminal modules.

17. The cable connector assembly as claimed in claim 11, wherein in each of said two terminal modules, said contacts include immoveable contacts and moveable contacts, and the immovable contacts are located closer to the inner surface than the moveable contacts.

* * * * *